US006405650B1

(12) United States Patent
Nakayama et al.

(10) Patent No.: US 6,405,650 B1
(45) **Date of Patent: *Jun. 18, 2002**

(54) CAMERA-READY COPY SHEET FOR LITHOGRAPIC PRINTING PLATE

(75) Inventors: Takao Nakayama; Seishi Kasai; Hiroyuki Ohishi, all of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/625,477

(22) Filed: Jul. 25, 2000

(30) Foreign Application Priority Data

Jul. 26, 1999 (JP) ..... 11-211365

(51) Int. Cl.[7] ..... B41N 6/00
(52) U.S. Cl. ..... 101/375; 101/382.1
(58) Field of Search ..... 101/141, 217, 101/375, 376, 382.1, 389.1, 401, 401.1, 401.3, 413, 415.1, 453; 492/18, 30, 37

(56) References Cited

U.S. PATENT DOCUMENTS 2,704,025 A * 3/1955 Anderson et al. ..... 101/415.1
4,367,679 A * 1/1983 Ishii et al. ..... 101/415.1
4,643,093 A * 2/1987 Goar et al. ..... 101/401.1
4,676,161 A * 6/1987 Peekna ..... 101/389.1
4,977,833 A * 12/1990 Inage et al. ..... 101/415.1
5,511,476 A * 4/1996 Banike et al. ..... 101/375
5,673,623 A * 10/1997 Schmid ..... 101/415.1
5,775,225 A * 7/1998 Saitou ..... 101/415.1
6,112,664 A * 9/2000 Naniwa et al. ..... 101/463.1
6,176,182 B1 * 1/2001 Nakayama et al. ..... 101/375

FOREIGN PATENT DOCUMENTS

EP 0 896 884 A1 2/1999
JP 11-020130 A 1/1999

* cited by examiner

*Primary Examiner*—Stephen R. Funk
(74) *Attorney, Agent, or Firm*—Reed Smith LLP

(57) ABSTRACT

The present invention provides for a camera-ready copy sheet to be inserted between a plate cylinder and a lithographic printing plate at least the back side of which is made of a non-metallic material. The copy sheet has asperities of a predetermined shape on the front side that are urged against the back side of the lithographic printing plate to depress it. The height of the projections in the asperities ranges from 5 $\mu$m to 50 $\mu$m. The sum per unit area of maximum cross-sectional areas of planes in the projections that are parallel to the surface of the sheet ranges from 0.2% to 4% of the unit area.

1 Claim, No Drawings

CAMERA-READY COPY SHEET FOR LITHOGRAPIC PRINTING PLATE

BACKGROUND OF THE INVENTION

1. Field of the Invention

The present invention relates to camera-ready copy sheet for use with lithographic printing plates to ensure that they will not be positionally offset on plate cylinders in a press.

2. Description of the Related Art

To perform printing with lithographic presses, a lithographic plate is wrapped around a plate cylinder and fixed mechanically.

Conventionally, the base of lithographic printing plates is made of either metals or non-metals such as plastics and paper. Compared to lithographic plates using metallic bases, those using non-metallic bases have good handling properties but, on the other hand, they do not have high dimensional stability.

When lithographic presswork is performed with plates having a non-metallic base on at least the back side, the softness of the base tends to reduce the accuracy of the positions in which the plate is gripped on to the leading edge of the plate cylinder. If this phenomenon occurs, the accuracy of the plate in the vertical position (i.e., the accuracy in the around-the-cylinder direction) decreases and, in an extreme case, the plate may be fixed slantwise. As a further problem, the friction with the cylinder during printing causes local distortion in the plate, eventually reducing the accuracy in position relative to the paper to be printed.

Under these circumstances, the use of lithographic plates having a n on-metallic base on at least the back side has been limited to the case of short-run work where no problem is caused even if printed pieces have low accuracy in register on the other hand, exquisite multi-color printing and long-run work on massive presses often fail to achieve the desired color register.

Platemaking and printing operations based on the computer-to-plate (CTP) technology have gained increasing acceptance these days and compared to the conventional approaches (in which the plate material is subjected to contact printing with a lithographic film), the new processes have the advantage of providing good dimensional and positional accuracy for the image (exposure) with respect to the plate material, as well as permitting easy registration in multi-color printing.

Of the two distinctive advantages of the CTP technology, the ease in registration for multi-color printing cannot be realized with lithographic plates based on non-metallic materials such as paper and plastics because they have the problems already described above.

In order to solve the above problem, it has recently been proposed that a sheeting having an initial elastic modulus of no more than 300 kg/mm$^2$ should be inserted between the lithographic printing plate and the plate cylinder [see Unexamined Japanese Patent Publication (kokai) No. 11 -20130 (1999)]. The sheet has fine particulate matter such as glass beads adhered and fixed thereto so that it has a center-line average roughness Ra of at least 2.

According to the specification of the patent, the sheet is prepared by adhering and fixing fine particulate matter such as glass beads on to the surface of a sheet material at high and uniform density. In other words, a highly concentrated liquid dispersion of fine particles is needed to form asperities on the sheeting.

Since the fine particulate matter of the type used in the patent is generally expensive, adhering and fixing it at high and uniform density inevitably increases the cost of the sheet. In addition, the fine particles cannot be easily dispersed in liquid at high concentration and, what is more, agglomeration often occurs in the highly concentrated dispersion and the resulting coarse particles will deteriorate the quality of printed matter.

SUMMARY OF THE INVENTION

It is an object of the present invention to provide a camera-ready copy sheet with which lithographic printing plates can be prevented from being positionally offset on a plate cylinder in a press. In the presence of such camera-ready copy sheet, lithographic plates using bases made of non-metallic materials can be applied to multi-color printing or long-run work. In addition, positional offset of plates can be suppressed by merely providing a small amount of particles on the surface of the copy sheet and this contributes to both cost reduction and easy production.

The present inventors conducted intensive studies in order to attain the stated object of the invention. As a result, it was found that by using a camera-ready copy sheet having asperities of a predetermined shape on the front side that are urged against the back side of a lithographic printing plate to depress it and in which the height of the projections in the asperities ranges from 5 $\mu$m to 50 $\mu$m and the sum per unit area of maximum cross-sectional areas of planes in said projections that are parallel to the surface of the sheet ranges from 0.2% to 4% of the unit area, the plate with which lithographic printing is being performed on a press can be positively prevented from being positionally offset on a plate cylinder primarily under the printing pressure. The present invention has been accomplished on the basis of this finding.

DETAILED DESCRIPTION OF THE INVENTION

The present invention will be described as follows in detail.

The present invention relates to a camera-ready copy sheet to be inserted between a plate cylinder and a lithographic printing plate at least the back side of which is made of a non-metallic material. In the camera-ready copy sheet, the copy sheet has asperities of a predetermined shape on the front side that are urged against the back side of the lithographic printing plate to depress it. The height of the projections in the asperities ranges from 5 $\mu$m to 50 $\mu$m. The sum per unit area of maximum cross-sectional areas of planes in the projections that are parallel to the surface of the sheet ranges from 0.2% to 4% of the unit area.

In the following description, the proportion of unit area that is occupied by the sum per unit area of maximum cross-sectional areas of planes in the projections that are parallel to the surface of the sheet is sometimes referred to as "occupied area percentage".

The fine particles to be used in forming asperities in the camera-ready copy sheet of the present invention are those having high hardness and ranging from 5 $\mu$m to 50 $\mu$m in diameter and examples include fine inorganic particles such as glass beads and the fine particles of comparatively hard polymers such as polystyrene. If the particles are coarsely distributed to occupy 0.2–4% of unit area, there is no need to use as large a number of fine particles as specified in Unexamined Japanese Patent Publication (kokai) No. 11-20130(1999), supra; instead, a comparatively small number of fine particles suffice to achieve positive prevention of positional offset of lithographic plates on the plate cylinder.

To compute the occupied area percentage as defined herein, the surface of a sample is photographed with an optical microscope from right above, the number (n) of projecting particles in a predetermined area S ($\mu m^2$) is counted, and the occupied area percentage is calculated from the average diameter R ($\mu$m) of the particles by the following formula:

$$\text{Occupied area percentage}=[n\times(\pi R^2/4)/S]\times 100(\%).$$

If the projections occupy no more than 3.14% of unit area, the center-line-average roughness Ra is smaller than 2 and the reason is as follows. If it is assumed that the projections are formed of particles, the center-line-average roughness Ra is practically governed by the larger particles. Assume here that the larger particles are 5–50 $\mu$m in diameter and also assume that the largest particles in this class are used. These particles have a diameter (height) of 50 $\mu$m, so in order for the center-line-average roughness Ra to be smaller than 2, no more than one particle with a diameter of 50 $\mu$m should exist in a rectangular space whose area is equivalent to 25 particles of the same diameter and may be expressed as the unit area S. If n=1 and S=25 $R^2$ are substituted into the formula set forth in the previous paragraph, the projection occupies $\pi$% of the unit area. Accordingly, if the particles with a diameter of 50 $\mu$m exist at a density that occupies no more than 3.14% of the unit area, the center-line-average roughness Ra is smaller than 2 and this is also the case if smaller particles exist at a density that occupies no more than 3.14% of the unit area.

The camera-ready copy sheet of the present invention can effectively prevent positional offset of lithographic printing plates even if the projections that constitute the asperities of a predetermined shape on the surface of the sheet are as few as noted above; if they are urged against the back side of the lithographic plate, the latter is sufficiently depressed that the plate with which lithographic printing is being performed on a press can be positively prevented from being positionally offset on a plate cylinder primarily under the printing pressure.

In the present invention, the back side of the lithographic plate may be depressed at the time when the camera-ready copy sheet is positioned between the lithographic plate and the plate cylinder while both the plate and the copy sheet are wrapped around the cylinder. Alternatively, it may not be until the printing pressure is applied after the copy sheet was positioned that the back side of the plate is depressed.

The lithographic printing plates that can be used in the present invention are not limited to any particular types and may be exemplified by common PS plates, plates having a silver diffusion type light-sensitive layer, and those prepared by electrophotographic platemaking processes.

Asperities can be formed on the surface of the base of the camera-ready copy sheet by two methods. In one method, the fine particles of a substance such as glass that is harder than the base of the lithographic plate are fixed on the surface of the base of the copy sheet. Alternatively, the base of the copy sheet is made of a material harder than the base of the lithographic plate and the surface of this base is directly processed to form asperities.

Specific examples of the first method of forming asperities on the surface of the copy sheet are: a dispersion of the fine particles in a binder is applied to the base and then dried; after a binder film is formed, the fine particles are pushed into the film under mechanical pressure; the fine particles are electrodeposited after the binder film was formed and the like.

Specific examples of the second method of forming asperities on the surface of the base of the copy sheet are: blasting, thermal spraying of metal, processing by electric discharge or laser beam, passing under a roller having fine projections formed on the circumference, and the like. There is another method of applying a photoresist to the base, printing a pattern of fine projections by exposure to light, stripping the resist by development, and etching the remaining surface.

The camera-ready copy sheet of the present invention may use any base materials that have good fit to the plate cylinder, as exemplified by plastics (e.g. polyethylene terephthalate, polypropylene and polyethylene), metals (e.g. aluminum and SUS), paper (e.g. natural or synthetic paper), and cloths.

The camera-ready copy sheet can be fixed to the plate cylinder by means of an adhesive layer that is provided on the back side of the copy sheet. The adhesive layer may be formed of any suitable adhesive such as sprayed glue or double-coated tape. Alternatively, both the leading and trailing edges of the copy sheet may be brought into direct engagement with clamps in the surface of the plate cylinder. If desired, the two methods may be combined.

We now describe the manner of carrying out the present invention in the mode under consideration. Before printing on a lithographic press, the respective plates are mounted on the plate cylinders in the associated printing units with the camera-ready copy sheet interposed. Each of the intervening copy sheets is urged against the back side of the lithographic printing plate to depress it by the projections forming the asperities on the surface of the copy base. In consequence, each copy sheet not only adjusts the printing pressure being exerted by the blanket cylinder and the impression cylinder but also prevents positional offset of the lithographic printing plate on the plate cylinder under pressure.

We next describe the method of preventing positional offset of the lithographic printing plate. The camera-ready copy sheet having asperities of a predetermined shape formed on the surface of the plate base is interposed between the plate and the plate cylinder in each printing unit in such a way that the asperities are urged against the back side of the plate, whereupon the latter is depressed in conformity with the asperities.

EXAMPLE

Samples of the camera-ready copy sheet according to the embodiment of the present invention, a copy sheet having no asperities on the surface, and samples having asperities formed under conditions outside the scope of the invention were set on a lithographic press and printing was performed to evaluate the positional offset that occurred to the lithographic printing plate on the plate cylinder. The specific conditions for copy sheet preparation and presswork and their results are set forth below.

Example

The surface of a polyethylene terephthalate (PET) base 100 $\mu$m thick was roller coated with a homogenized dispersion of the recipe indicated below. This gave samples of the copy sheet according to the embodiment under consideration which had high areas formed on the surface from glass beads. The glass beads (GB 731 of Toshiba Glass Co., Ltd.) were classified to a size range of 3–60 $\mu$m with a powder centrifuge and mixed with a binder acrylic resin (40% in toluene) in controlled ratios to prepare samples having different occupied area percentages.

(Prescription)

| Glass beads: | |
|---|---|
| 3 μm in diameter | 0.1 g |
| 5 μm in diameter | 0.1 g |
| 20 μm in diameter | 0.2 g |
| 40 μm in diameter | 0.2 g |
| 50 μm in diameter | 0.3 g |
| 60 μm in diameter | 0.3 g |
| Acrylic resin (40% in toluene) | 20 g |
| Toluene | 80 g |

The lithographic printing plate was prepared by a dedicated platemaker SPM 415 from super Master Plus of AGFA-Gevaert AG which was a silver diffusion type light-sensitive material using a PET base 100 μm thick. The plate had a total thickness of 130 μm. The lithographic printing plate may be replaced by a PS plate having an image-receiving layer on a non-metallic base or an electrophotographically made plate.

The copy sheet and the lithographic printing plate were each cut to a width of 560 mm and a length of 400 mm and placed one on the other so that the roughened surface of the copy sheet was in contact with the back side of the lithographic printing plate. The assembly was mounted on the plate cylinder of Oliver 52 (non-perfecting or one-side printing press of Sakurai Co., Ltd.) to print ruled lines on 2000 sheets of paper.

Prior to printing, the surface of the lithographic printing plate was squeezed with sponge impregnated with processing solution G671c. The dampening water on the press was a 1:1 aqueous dilution of G671c. The ink was New Champion F Gloss 85 of DAINIPPON INK AND CHEMICALS, INC.

The initial positions of the ruled lines were compared with those on the last printed paper to evaluate the positional offset that had occurred to the lithographic printing plate on the plate cylinder during 2000 impressions.

No positional offset was found to have occurred to the lithographic printing plate samples of the invention on the plate cylinder.

Comparative Example

Comparative samples of camera-ready copy sheet were prepared from the same base as used in the Example, except that it was not provided with any asperities or provided with asperities having particle sizes and/or occupied area percentages outside the scope of the present invention. These comparisons were assembled with the same lithographic printing plate as in the Example and 2000 sheets of paper were printed on the same press as in the Example.

The results of evaluation are shown in Table 1 below. In each of the columns in the table, the evaluation for "plate offset" is noted on the left side and that for "uneven printing" on the right side. The data for the Example of the invention are bounded by a rectangle in thick lines.

TABLE 1

| Occupied area percentage (%) | Particle's diameter (μm) | | | | | |
|---|---|---|---|---|---|---|
| | 3 | 5 | 20 | 40 | 50 | 60 |
| 0.1 | ×○ | ×○ | ×○ | △○ | △○ | ○× |
| 0.2 | ×○ | ○○ | ○○ | ○○ | ○○ | ○× |
| 0.5 | ×○ | ○○ | ○○ | ○○ | ○○ | ○× |
| 1.0 | ×○ | ○○ | ○○ | ○○ | ○○ | ○× |
| 2.0 | ×○ | ○○ | ○○ | ○○ | ○○ | ○× |
| 3.0 | ×○ | ○○ | ○○ | ○○ | ○○ | ○× |
| 4.0 | ×○ | ○○ | ○○ | ○○ | ○○ | ○× |
| 5.0 | ×○ | △○ | ○× | ○× | ○× | ○× |
| 7.0 | ×○ | △○ | ○× | ○× | ○× | ○× |

The data in table 1 were obtained by the following criteria for evaluation.

(Rating criteria)

Plate offset: ○(<50 μm), Δ(50–100 μm), ×(>100 μm)

Uneven printing: ○(no unevenness), Δ(limited unevenness), ×(extensive unevenness)

The unevenness in printing that was evaluated on the printed matter in addition to the plate offset may reasonably be taken to occur by the following mechanism: any coarse particles on the copy sheet interposed between the lithographic printing plate and the plate cylinder deform the soft plate base material such as PET during printing so that the surface of the deformed area of the lithographic printing plate is raised to cause scumming in spots, which is recognized as "uneven print" on the printed matter.

As one can see from Table 1, the camera-ready copy sheet of the invention which is to be inserted between a plate cylinder and a lithographic printing plate and which has asperities of a predetermined shape on the front side that are urged against the back side of the lithographic printing plate to depress it, the projections in the asperities ranging from 5 μm to 50 μm in height and occupying 0.2% to 4% of unit area, can effectively prevent not only plate offset but also scumming of non-image areas.

The camera-ready copy sheet of the present invention has asperities of a predetermined shape on the front side that are urged against the back side of the lithographic printing plate to depress it and the projections in the asperities range from 5 μm to 50 μm in height and occupy 0.2% to 4% of unit area. Positional offset of lithographic plates can be suppressed by merely providing a small amount of particles on the surface of the copy sheet and this contributes to both cost reduction and easy production.

What is claimed is:

1. A camera-ready copy sheet to be inserted between a plate cylinder and a lithographic printing plate at least the back side of which is made of a non-metallic material, said copy sheet having asperities of a predetermined shape on the front side that are urged against the back side of the lithographic printing plate to depress it, a height of the projections in the asperities ranging from 5 μm to 50 μm, and the sum per unit area of maximum cross-sectional areas of planes in said projections that are parallel to the surface of the sheet ranging from 0.2% to 4% of the unit area.

* * * * *